United States Patent [19]

Sze

[11] Patent Number: 4,691,003

[45] Date of Patent: Sep. 1, 1987

[54] UNIFORM POLYMERIC FILAMENTS

[75] Inventor: Benjamin C. Sze, Wilmington, Del.

[73] Assignee: E. I. Du Pont de Nemours and Company, Wilmington, Del.

[21] Appl. No.: 857,278

[22] Filed: Apr. 30, 1986

[51] Int. Cl.[4] ..... C08G 63/02

[52] U.S. Cl. ..... 528/308.1; 528/272; 528/308.2

[58] Field of Search ..... 528/272, 308.1–308.2; 264/211.14, 211.15, 211.17, 211.22

[56] References Cited

U.S. PATENT DOCUMENTS

| | | | |
|---|---|---|---|
| 2,604,667 | 7/1952 | Hebeler | 264/210.8 |
| 4,134,882 | 1/1979 | Frankfort et al. | 528/309 |
| 4,195,051 | 3/1980 | Frankfort et al. | 264/176 |
| 4,338,275 | 7/1982 | Carr | 264/211.15 |
| 4,415,726 | 11/1983 | Tanki et al. | 528/272 |
| 4,426,516 | 1/1984 | Kuriki et al. | 528/272 |
| 4,491,657 | 1/1985 | Saito et al. | 528/308.1 |

OTHER PUBLICATIONS

High Speed Spinning of Poly(ethylene terephthalate) Structure Development and Its Mechanism, Shimizu et al., (Jun. 1983).

Fiber World, Sep. 1984, pp. 8–12.

*Primary Examiner*—Lucille M. Phynes

[57] ABSTRACT

Improved polymeric filaments spun at high withdrawal speeds of the order of more than 5 km/min, and preferably of 7–12 km/min, wherein the freshly-extruded filaments enter an enclosed zone that is maintained at superatmospheric pressure by a controlled flow of heated air at a low positive pressure.

1 Claim, 2 Drawing Figures

UNIFORM POLYMERIC FILAMENTS

BACKGROUND OF THE INVENTION

This invention concerns new uniform polymeric filaments prepared by an improved process of melt-spinning at controlled high withdrawal speeds.

It has long been known that polymeric filaments, such as polyesters, can be prepared directly, i.e., in the as-spun condition, without any need for drawing, by spinning at high speeds of the order of 5 km/min or more. This was first disclosed by Hebeler in U.S. Pat. No. 2,604,667 for polyesters. There has been increased interest in the last 10 years, as shown by the number of patent specifications disclosing methods of melt-spinning at these high spinning speeds.

Frankfort et al. in U.S. Pat. Nos. 4,134,882 and 4,195,051 disclose new uniform polyester filaments and continuous filament yarns of enhanced dyeability, low boil-off shrinkage and good thermal stability, prepared by spinning and winding directly at withdrawal speeds of 5 km/min or more. The highest speed exemplified is 8000 ypm. The withdrawal speed is the speed of the first driven roll wrapped (at least partially) by the filaments, i.e., the feed roll. When uniform polymeric filaments are desired, such as are suitable for continuous filament yarns, for example, it is essential to use a roll or equivalent positive means, driven at a constant controlled speed to withdraw the filaments, as opposed to an air jet ejector. The latter is satisfactory for some uses, such as non-woven products, but does not produce filaments that are sufficiently uniform for use as continuous filament yarns for most purposes.

Tanji et al. U.S. Pat. No. 4,415,726 reviews several earlier references and discloses polyester filaments and yarns capable of being dyed under normal pressure, and a process for producing such polyester yarns with improved spinning stability at controlled high spinning (i.e., winding) speeds of at least 5 km/min. Sudden quenching and cross-flow quenching are avoided. The extruded filaments preferably pass through a heating zone of at least 150° C. An important element is the subjection of the filaments to a vacuum or suction by an aspirator. This preferably gives the filaments a velocity of more than one tenth of the spinning speed. The heating zone and the aspirator are separated by a distance sufficient to avoid the filaments sticking together at the aspirator. The heating zone and the aspirator achieve high spinning efficiency and stability at high speed spinning. Tanji's examples 9–14 show the use of both heating zone and aspirator, while examples 1–7 show radial quench without any heating zone or aspirator. These examples produce polyester yarn having properties seemingly comparable to each other at respective speeds of 7, 8 and 9 km/min which latter is the highest winding speed used in the examples. Tanji do discuss the possibility of use of speeds up to 12 km/min.

Tanji do not explain why their polyester fibers have improved dyeability, but Shimizu et al. in a paper entitled "High Speed Spinning of Poly(ethylene terephthalate) Structure Development and Its Mechanism," given at the 22nd International Synthetic Fiber Symposium at Dornbirn in June, 1983, analogize an increase in dyeability with voids in the surface (sheath), which is consistent with a reduction in birefringence and mechanical properties. Shimizu et al. are among other experts who have noted that necking (neck-like deformation) take place when polyester filaments are spun at high speeds of the order of 5 km/min.

It would be very desirable from an economic viewpoint to melt-spin filaments and yarns having similar or better mechanical properties at even higher speeds, even if this would mean that the polyester products, for example, would have only the normal dyeability associated with conventional polyester filaments instead of any improved dyeability associated with the voids created by spinning as disclosed by Tanji et al. However, an article by Professor A. Ziabicki in *Fiber World*, September, 1984, pages 8–12, entitled "Physical Limits of Spinning Speed" questions whether higher speeds can yield fibers with better mechanical properties, and whether there are any natural limits to spinning speed which cannot be overcome (concentrating on physical and material factors only, and excluding economical and technical aspects of the problem). Professor Ziabicki concludes that there exists such a speed, beyond which no further improvement of structure and fiber properties is to be expected. In the case of polyester filaments studied in two references, referred to, the maxima appear to Professor Ziabicki to be around 5–7 km/min. This is consistent with the results shown by Tanji at speeds up to 9 km/min and by Shimizu.

Accordingly, it was very surprising to provide an improved process for obtaining polymeric filaments and yarns by melt-spinning at even higher speeds, without the accompanying deterioration in mechanical properties that has been shown and predicted in the prior art.

In contrast to Tanji's disclosure of preparing polymeric filaments by winding at high withdrawal speeds, with an aspirator to assist the withdrawal of the filaments from the spinneret, there have been several disclosures of preparing polymeric filaments by extruding into a pressurized chamber and using air pressure, e.g., an air nozzle or an aspirator to withdraw the filaments from the pressurized chamber without use of any winder or other positively-driving roll to advance the filaments at a controlled speed. The resulting filaments have many uses, especially in non-woven fabrics, but do not have the uniformity required for most purposes as continuous filament yarns, because of the inherent variability (along the same filament and between different filaments) that results from use of only an air jet to advance the yarns, i.e., without a winder or other controlled positive-driving mechanism. Indeed, the resulting filaments are often so non-uniform as to be spontaneously crimpable, which can be of advantage, e.g., for use in non-wovens, but is undesirable for other uses.

SUMMARY OF THE INVENTION

According to the invention, there is provided an improved process for melt-spinning uniform polymeric filaments through capillaries in a spinneret at controlled high withdrawal speeds of at least 5 km/min involving necking of the filaments at a location below the spinneret, wherein a cocurrent flow of gas is used to assist the withdrawal of the filaments, the improvement being characterized in that said gas is directed, under a controlled positive pressure of less than about 1 kg/cm$^2$, into an enclosed zone located immediately below the spinneret and maintained under superatmospheric pressure, and that the filaments pass down out of said zone through a venturi, having a converging inlet and a flared outlet connected by a constriction that is positioned above the necking location of the filaments.

Spinning continuity can be improved at these high withdrawal speeds by these means which smoothly accelerate the cocurrent air-flow and thereby tension the filaments close to the face of the spinneret. The velocity of heated air or other gas in the venturi may be about one and one half (1.5) to about one hundred (100) times the velocity of the filaments so that the air exerts a pulling effect on the filaments and maintains them at a temperature of at least 140° C. As a result of the higher velocity and high temperature of the filaments leaving the venturi, the extent of necking down that would otherwise be normally experienced by the filaments at these high speeds is appreciably reduced, so that the filaments are oriented more highly and more uniformly (less difference between amorphous sections and crystalline sections). Consequently, the filaments have higher tenacity and there is better spinning continuity, especially as the withdrawal speed is increased beyond 7 km/min.

It is surprising that it is possible for multiple strands of hot sticky polymer to converge and pass through a venturi with a relatively small constriction with sufficient stability that they would not stick to each other, or adhere significantly to the wall of the venturi. One reason for such success may be the extremely low superatmospheric pressure in the zone above the venturi. Because of the nature of the strands immediately under the spinneret, it is not practical to correct any problem of sticking by means of a guide. If filaments touch each other, they would be expected to coalesce, as has been taught in the art, and it would be very difficult to separate them. Similarly, each time a filament touches the funnel it will leave a polymer deposit, thus further increasing the future tendency for sticking. As many as 34 filaments have been spun successfully at 310° C. (some 40° above the melting point of the polymer) through a venturi with a constriction about 1 cm in diameter.

An aspirating jet is preferably used downstream of the neck-draw point, i.e., below the venturi to assist cooling and further reduce aerodynamic drag so as to further reduce spinning tension and increase spinning continuity.

The polyester filaments of this invention are further defined by FIG. 2 which is a graph of tenacity at break (grams per denier) vs. DSC endotherm temperature (melting point °C.). The polyester filaments of this inveniton fall within the area defined by ABCDA in FIG. 2 with a tenacity at break at least greater than that established by the line BC in the graph. this can also be expressed by the relationship $t=79.89-0.278T$ where T is the DSC endotherm temperature and t is the tenacity at break in grams per denier.

DETAILED DESCRIPTION OF THE ILLUSTRATED EMBODIMENT

Figure 1:
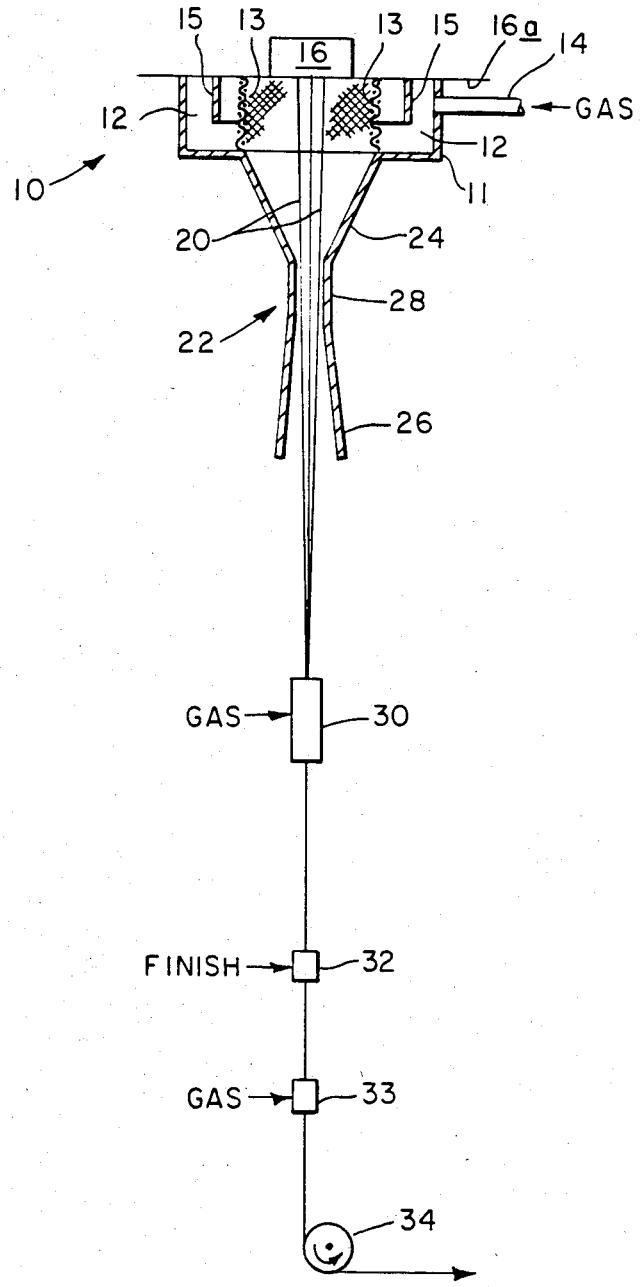
FIG. 1 is a schematic elevation view partially in section of an apparatus used in practicing the invention.
Figure 2:
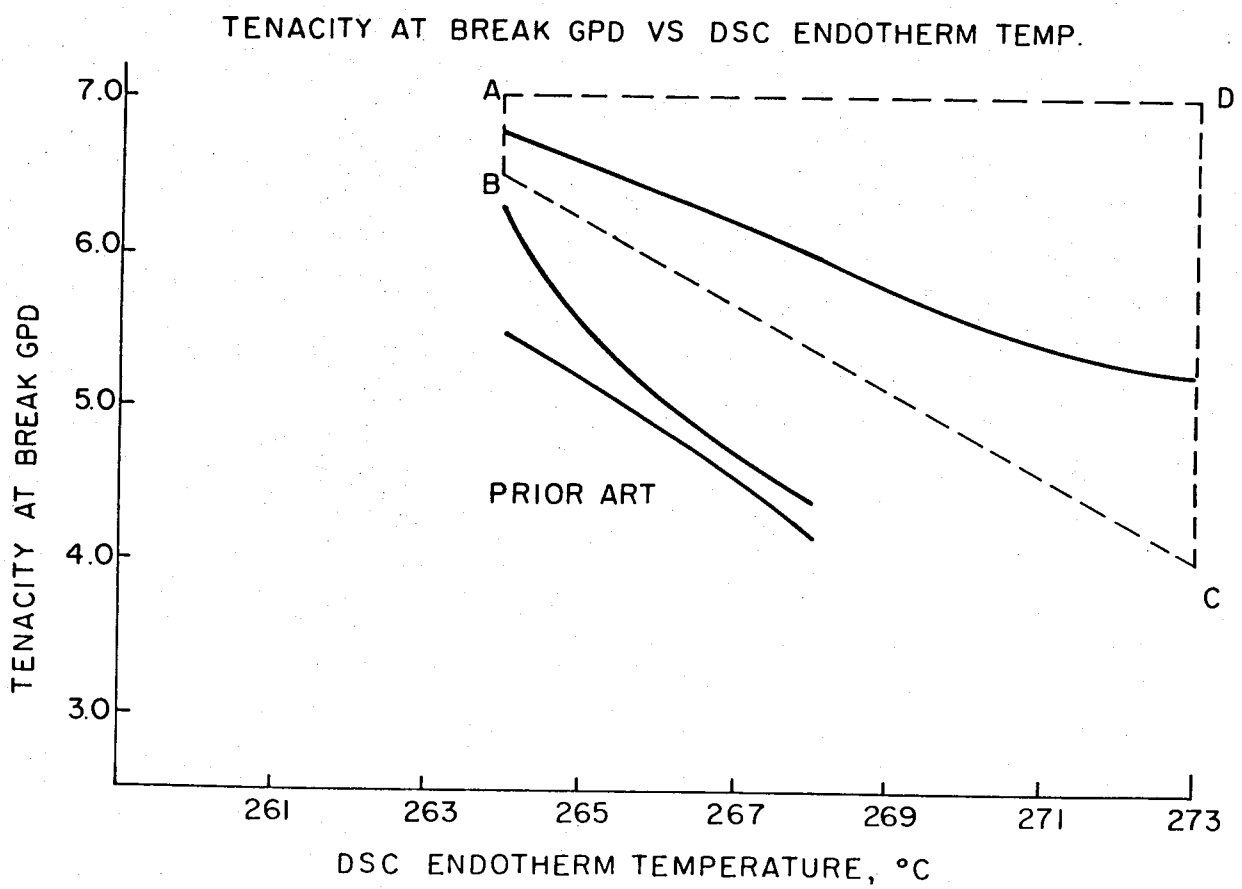
FIG. 2 is a graph of tenacity at break vs. DSC endotherm temperature for the polyester filaments of this invention.

Referring to the drawing, the embodiment chosen for purposes of illustration includes a housing 10 which forms a chamber 12, i.e., a laterally enclosed zone supplied with heated inert gas through inlet conduit 14 which is formed in the side wall 11 of the housing. A circular screen 13 and a circular baffle 15 are concentrically arranged in housing 10 to uniformly distribute the gas flowing into chamber 12. A spinning pack 16 is positioned centrally with and directly above the housing. A spinneret (not shown) is attached to the bottom surface of the spinning pack for extruding filaments 20 into a path from molten polymer supplied to the pack. A venturi 22 comprising a flared inlet 24 and a flared outlet 26 connected by a constriction 28 is joined at its inlet to housing 10. An aspirating jet 30 located downstream of the venturi 22 is followed by a withdrawal roll 34.

In operation, a molten polymer is metered into spinning pack 16 and extruded as filaments 20. The filaments are pulled from the spinneret by withdrawal roll 34 assisted by the gas flow through the venturi 22 and the aspirating jet 30.

The terms withdrawal speed and spinning speed, and sometimes winding speed are used when discussing Frankfort et al. and Tanji, to refer to the linear peripheral roll speed of the first driven roll that positively advances the filaments as they are withdrawn from the spinneret. According to the invention, while the air flow through the funnel, preferably the venturi 22, and through the aspirator 30 is important in assisting to pull the filaments 20 away from the spinneret, and so in assisting withdrawal, as the filaments pass onwards and accelerate, usually against some aerodynamic drag, towards such first positively-driving roll 32, such air flow is not the only force responsible for withdrawal of the filaments. This contrasts with the prior art such as is mentioned above, which uses air flow as the only means of withdrawing and drawing filaments from the spinneret, i.e., which has not used a high speed roll or winder in addition to the aspirator, air ejector or other air flow device.

The temperature of the gas in the enclosed zone 12 may be from 100° C. to 250° C. If the gas temperature is too low, it tends to cool the filaments too quickly, resulting in less uniform orientation across the fiber cross-section and low tenacity. If the gas temperature is too high, spinnability becomes difficult. The preferred distance between the face of the spinneret located at the lower surface of spinning pack 16 and the throat of the funnel or restriction 28 of venturi 22 is from about 6 to 60 inches (15.2 to 76.2 cm.). If this distance is too long, the stability of the filaments in the pressurized zone above may suffer. The diameter (or equivalent width of the cross-sectional area) of the throat or restriction 28 should preferably be from about 0.25 to 1 inch (0.6 to 2.5 cm.) but this will depend to some extent on the number of filaments in the bundle. If a rectangular slot is used, the width may be even less, e.g., as little as 0.1 inches. If the width is too small, the filaments may touch each other in the nozzle and fuse. If the diameter of constriction 28 is too large, a correspondingly large amount of gas flow will be required to maintain the desired velocity at the throat and this may cause undesirable turbulence in the zone and so filament instability will result.

The pressure in the housing 10 should be high enough to maintain the desired flow through the venturi 22. Normally, it is between about 0.05 psig (0.003 kg/cm.$^2$) to 1 psig (0.07 kg/cm.$^2$), depending on the dimensions, and on the filaments being spun, namely the denier, viscosity and speed. As mentioned, a low superatmospheric pressure is important.

Below the constriction 28 is a flared outlet 26, which should preferably be of length between about 1 and 30 inches, depending on the spinning speed. If the length is too short, the concurrently flowing air would exert on the filaments too small a drag force to be beneficial. If the length is too long, it may enclose the neck-draw point, which would mean that the yarn would not get sufficient early cooling with an adverse effect on continuity. The preferred geometry of the flared outlet 26 is divergent with a small angle, e.g., 1° to 2° and not more than about 10°, so that the flared inlet 24, the constriction 28, and the flared outlet 26 together form a venturi. This allows the high velocity air to decelerate and reach atmospheric pressure at the exit from this section without gross eddying, i.e., excessive turbulence. Less divergence, e.g., a constant diameter tube may also work at some speeds, but would require a higher supply pressure to obtain the same gas flow. More divergence leads to excessive turbulence and flow separation.

Upon emerging from the venturi 22, the yarn cools rapidly until it reaches the neck-draw point. The velocity of the yarn at various distances from the face of the spinneret has been determined by a Laser Doppler Velocimeter. A very rapid and sudden jump in velocity was detected at the neck-draw point and it is believed that this is accompanied by a jump in yarn tension, with increased stability of the filament. The position of the neck-draw point varies according to the spinning speed, other conditions being similar; the faster the spinning speed, the closer is the neck-draw point to the spinneret. It is also influenced by the throughput, spinning temperature, denier per filament and the temperature of the gas in the housing 10 as well as by the geometry of the venturi 22. Without a venturi, at 9 km/min a neck-draw point only about 17 inches below the spinneret for 2.5 dpf polyester yarn, and a neck-draw ratio of about 14 has been noted. With a venturi, however, as preferred, a neck-draw point 30 inches below the spinneret and a neck-draw ratio of only 4.5 has been noted.

The lower neck-draw ratio may be at least partly responsible for the improvement in tenacity and continuity, although the invention is not limited to any theory. When orientation develops across the neck-draw, the time available for this development is extremely short, on the order only of microseconds. Within such a short time span, it is difficult for long chain molecules to pull through many entanglements that may exist in the melt. Hence, many domains of amorphous chains of low orientation may be carried over into the yarn after neck-draw. The higher the neck-draw ratio, the larger and more likely are these domains and the lower is the average amorphous orientation. Since the use of a venturi significantly reduces the neck-draw ratio at constant spinning speed, it increases the average amorphous orientation and hence the yarn tenacity and density. Amorphous orientation can be calculated by subtracting from the total birefringence of the filament the crystalline contribution from wide angle X-ray diffraction. Crystallinity of the filament is determined by the density of the filament. These calculations show the amorphous orientation of a filament spun with a venturi is appreciably higher than that of a filament spun at the same speed without a venturi.

Filaments emerging from the venturi are allowed to cool in the atmosphere, preferably for a short distance before entering an aspirating jet 30 placed at a suitable distance down stream of the venturi 22. Normally neck-draw takes place in this zone between the venturi and the aspirating jet 30. It is desirable to separate the aspirating jet from the venturi because the amount of air aspirated with the filaments by the aspirating jet may be substantially larger than the amount of air flowing out from the venturi; this avoids a large mismatch in flow rates which would lead to turbulence and yarn instability. The function of the aspirating jet is to cool the filaments rapidly to increase their strength and to reduce the increase in spinning tension due to aerodynamic drag.

As usual, a finish (anti-stat, lubricant) is applied to the filaments by means of applicator 32. This should be downstream of the aspirating jet 30, but usually ahead of the withdrawal roll 34. An interlacing jet 33 may be used to provide the filaments with coherence, when the object is to prepare a continuous filament yarn. This is located downstream of any finish applicator.

The invention makes possible the preparation of polyester fiber having a novel combination of dyeability, strength and thermal stability. Preferably a spinning speed of at least about 7,000 m/min is used to prepare these new polyester fibers, such as are capable of being processed under normal weaving or knitting conditions and of being dyed under normal pressures.

The invention is further illustrated in the following Example:

EXAMPLE

Polyethylene terephthalate, having an intrinsic viscosity of 0.63 which is measured in a mixed solution of 1:2 volume ratio of phenol and tetrachloroethane, was extruded from a spinneret having 17 fine holes of 0.25 mm dia equally spaced on a circumference of a circle of 5 cm in diameter at a spinning temperature of 310° C. The extruded filaments were passed through a heating cylinder with an inside diameter of 11.5 cm and a length of 13 cm provided immediately below the surface of the spinneret. The cylinder was maintained at a temperature of 180° C. and air at the same temperature was supplied through the wire mesh inside surface of the cylinder at the rate of 4.5 scfm. The cylinder was connected to a converging tube with a throat diameter of 9.5 mm (0.375") located at the end of the tube 30 cm from the spinneret. Beyond the throat is a divergent tube (forming a venturi) of 17 cm in length with a divergence cycle of 2°. The heated cylinder is sealed against the bottom of spinning block so that air supplied through the cylinder can only escape through the throat of convergent tube and the venturi. A positive pressure of about 0.15 (0.01 Kg/cm.$^2$) psi is maintained in the chamber below the spinneret. Upon leaving the venturi tube, the filaments travel in air for about 30–80 cm before entering an aspirating jet supplied with air pressure of 3 psig. The filaments have a denier of 42.5/17 (2.5 dpf). The denier was maintained at speeds of 7,000 m/min to 12,000 m/min by adjusting polymer feed through the spinneret capillaries. Properties of the fibers are shown in the Table.

TABLE

| Spinning Speed m/min | DSC Endotherm °C. | Ten at Break g/d |
|---|---|---|
| 7,000 | 264 | 6.8 |
| 8,000 | 266 | 6/4 |
| 9,000 | 268 | 6.0 |
| 10,000 | 269 | 5.7 |
| 11,000 | 271 | 5.4 |

TABLE-continued

| Spinning Speed m/min | DSC Endotherm °C. | Ten at Break g/d |
|---|---|---|
| 12,000 | 273 | 5.2 |

Ten. at Break - tenacity at break is in grams per denier, measured according to ASTM D2256 using a 10 in. (25.4 cm) gauge length sample, at 65% RH and 70 degrees F., at an elongation rate of 60% per min.

Boil Off Shrinkage (BOS) - measured as described in U.S. Pat. No. 4,156,071 at Column 6, line 51.

DSC Endotherm - the endotherm (melting point) is determined by the inflection point of a differential scanning calorimeter curve, using a Du Pont model 1090 Differential Scanning Calorimeter operated at a heating rate of 20° C./min. After heatingto 300° C. and cooling down to <150° C., the polymer is reheated at 20° C./min. The endotherm of the polymer in the reheat cycle is 253° C.

What is claimed is:

1. A continuous filament polyester yarn spun at a spinning speed of at least 8 Km/min having a DSC endotherm temperature in the range of from about 264 to about 273 degrees centigrade and having a tenacity at break greater than that expressed by the relationship $t=79.89-0.278T$ wherein T is the DSC endotherm temperature in degrees centigrade and t is the tenacity at break in grams per denier.

* * * * *